US005378056A

United States Patent [19]

Wilson et al.

[11] Patent Number: 5,378,056

[45] Date of Patent: Jan. 3, 1995

[54] TRIANGLE DISPLAY AND STORAGE STAND

[76] Inventors: Jewell Wilson, 309 S. 50th Ave.; Alvin Norman, 8101 W. Noghill, both of Yakima, Wash. 98908

[21] Appl. No.: 953,532

[22] Filed: Sep. 28, 1992

[51] Int. Cl.[6] ..... A47F 5/00

[52] U.S. Cl. ..... 312/249.8; 312/249.13; 312/265.1; 211/189

[58] Field of Search ..... 312/249.8, 249.13, 138.1, 312/265.1, 265.2; 211/187, 188, 189

[56] References Cited

U.S. PATENT DOCUMENTS

| | | | |
|---|---|---|---|
| 845,707 | 2/1907 | Randolph | 312/249.8 |
| 3,330,229 | 7/1967 | Ferdinand et al. | 211/187 X |
| 3,931,894 | 1/1976 | Murphy | 211/189 |
| 5,078,283 | 1/1992 | Wilson | 211/187 |

OTHER PUBLICATIONS

"Instructions for PAC-N-STAC Triangle Displays--Model 344D & Model 244 Princess" Printed for PAC--N-STAC, 3204 Fruitvale Boulevard, Yakima Wash. 98902.

*Primary Examiner*—Joseph M. Gorski
*Attorney, Agent, or Firm*—George A. Cashman

[57] ABSTRACT

A display and storage stand for retail stores comprises three triangular platforms, one above the other. Each triangle is truncated at each apex. The triangles are joined at their truncated portions by steel bars bolted to the triangles. Two sides of the stand are enclosed by panels. The third side is closed by a door. Each steel bar has shelf bracket projections along each longitudinal side. Shelves may be horizontal or tilted. Projecting rods for bagged and blister-packed items are provided. Wheels are attached to the under side of the base triangle.

4 Claims, 6 Drawing Sheets

TRIANGLE DISPLAY AND STORAGE STAND

BACKGROUND OF THE INVENTION

In retail stores which sell shelf items, there is a need for a display stand which can be easily moved to accommodate different traffic patterns. There is also a need for storage space for the shelf items. If the shelf items are stored where the items are sold, the sales personnel can easily re-stock the shelves.

BRIEF DESCRIPTION OF THE INVENTION

The triangle display and storage stand comprises three triangular metal elements, a base triangle, a center triangle, and a top triangle, each triangle having dependent metal sides, and said triangles being disposed one above the other. Vertical bars are bolted to the truncated apexes of each such triangle. Each bar has, on both longitudinal sides, projections suitable for retaining shelf brackets. Two sides of the resulting structure are enclosed by panels. The third side is enclosed by means of a hinged door. Wheels are attached to the bottom of the base triangle. The stand can accommodate horizontal shelves, tilted shelves, grille-type shelves and bars having projecting rods for bagged and blister-packed items.

DETAILED DESCRIPTION OF THE INVENTION

Figure 1:
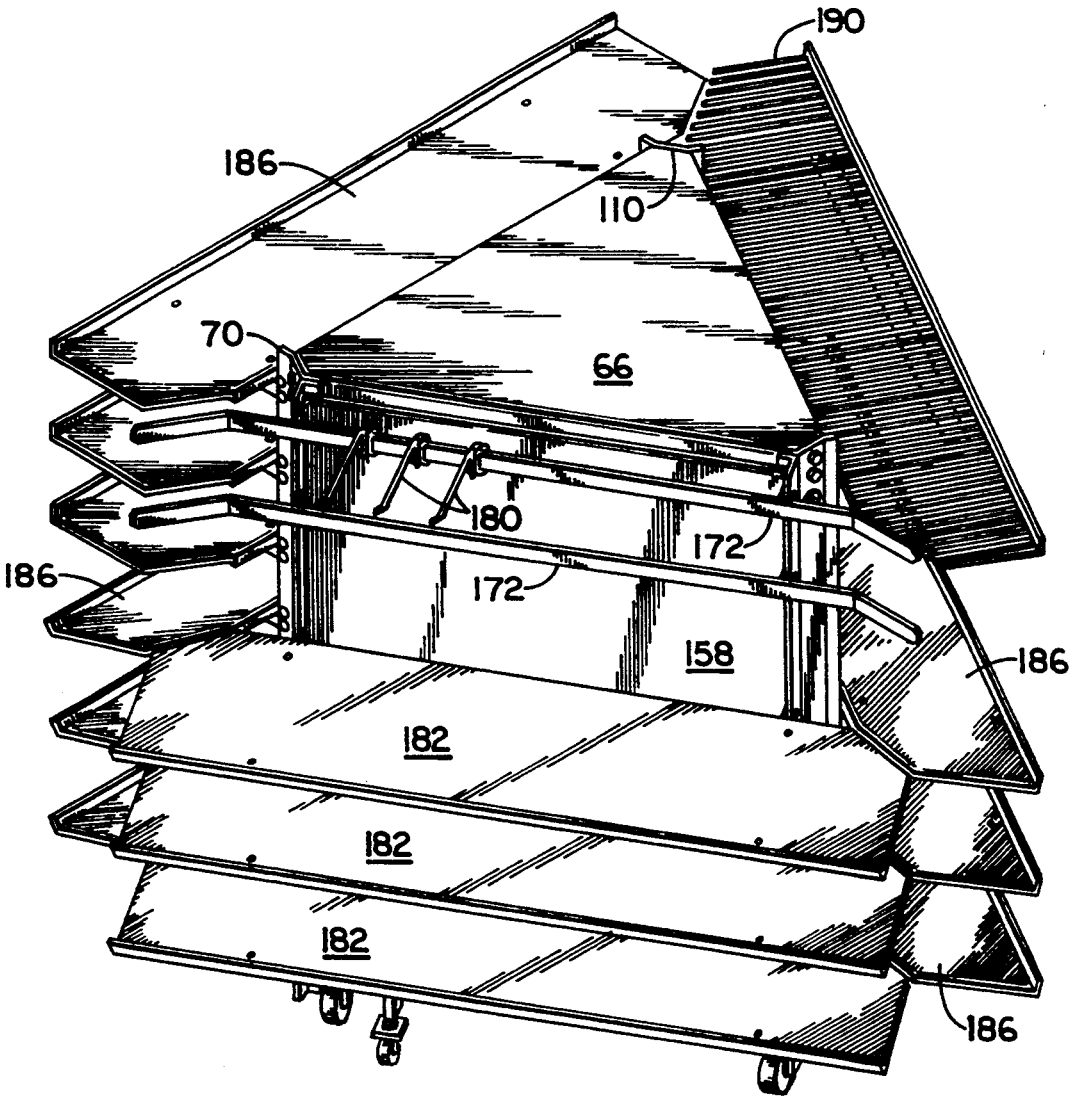
FIG. 1 illustrates the fully assembled triangle display and storage stand having shelves of various kinds attached.

The display and storage stand of this invention is illustrated, completely assembled, in FIG. 1, and is designated generally as 10. The stand 10 is made entirely of metal.

There are three triangles, base triangle 12, center triangle 14 and top triangle 16. Each triangle is truncated at all three its apexes.

Base triangle 12 has sides 18, 20 and 22 welded to its edges, each side being perpendicular to the surface 24 of triangle 12.

Additionally, base triangle 12 has web 26 welded into the corner joining side 18 and side 20 and truncation piece 28. Web 30 is welded into the corner joining side 20 and side 22 and truncation piece 32. Web 34 is welded into the corner joining side 22 and side 18 and truncation piece 36. Webs 26, 30 and 34 are each provided with tapped holes 38 for mounting the wheels. Caster wheel 40 is bolted to web 34 by means of bolts 42. Fixed wheel 44 is bolted to web 30 by means of bolts 42, and fixed wheel 46 is bolted to web 26 by means of bolts 42.

Center triangle 14 has sides 48, 50 and 52, each of which is perpendicular to surface 54. Truncation piece 56 joins sides 48 and 50. The truncation pieces joining sides 50 and 52 and joining sides 52 and 48 are not shown. There is a rectangular cutout 58 in side 48, extending part way into surface 54. The purpose of cutout 58 is to accommodate the door hinge which will be described below.

Top triangle 16 has sides 60, 62 and 64, each of which is perpendicular to surface 66. Truncation piece 68 joins sides 60 and 62. The truncation pieces joining sides 62 and 64 and joining sides 64 and 60 are not shown.

Figure 2:
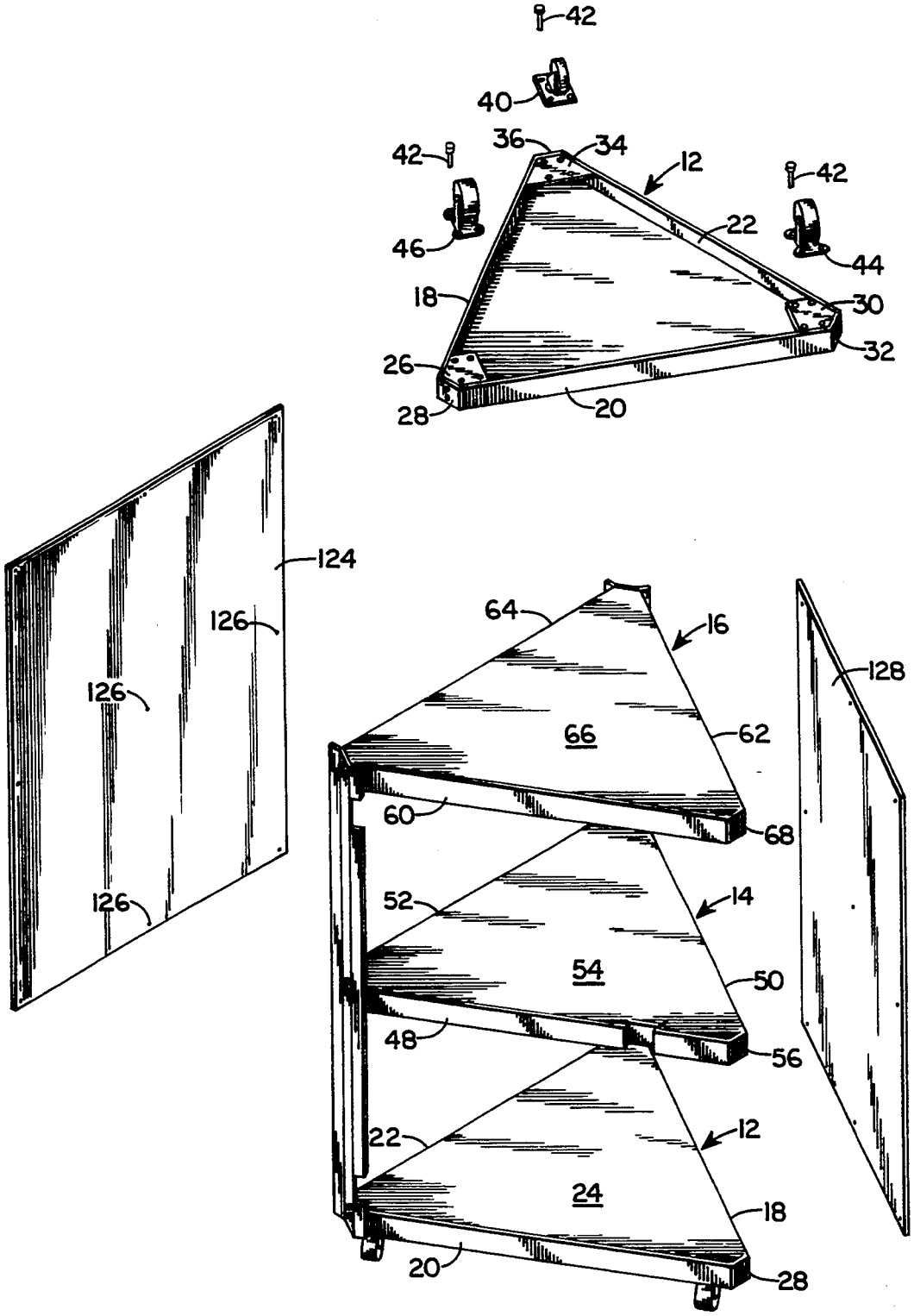
FIG. 2 illustrates the stand partially assembled.
Figure 3:
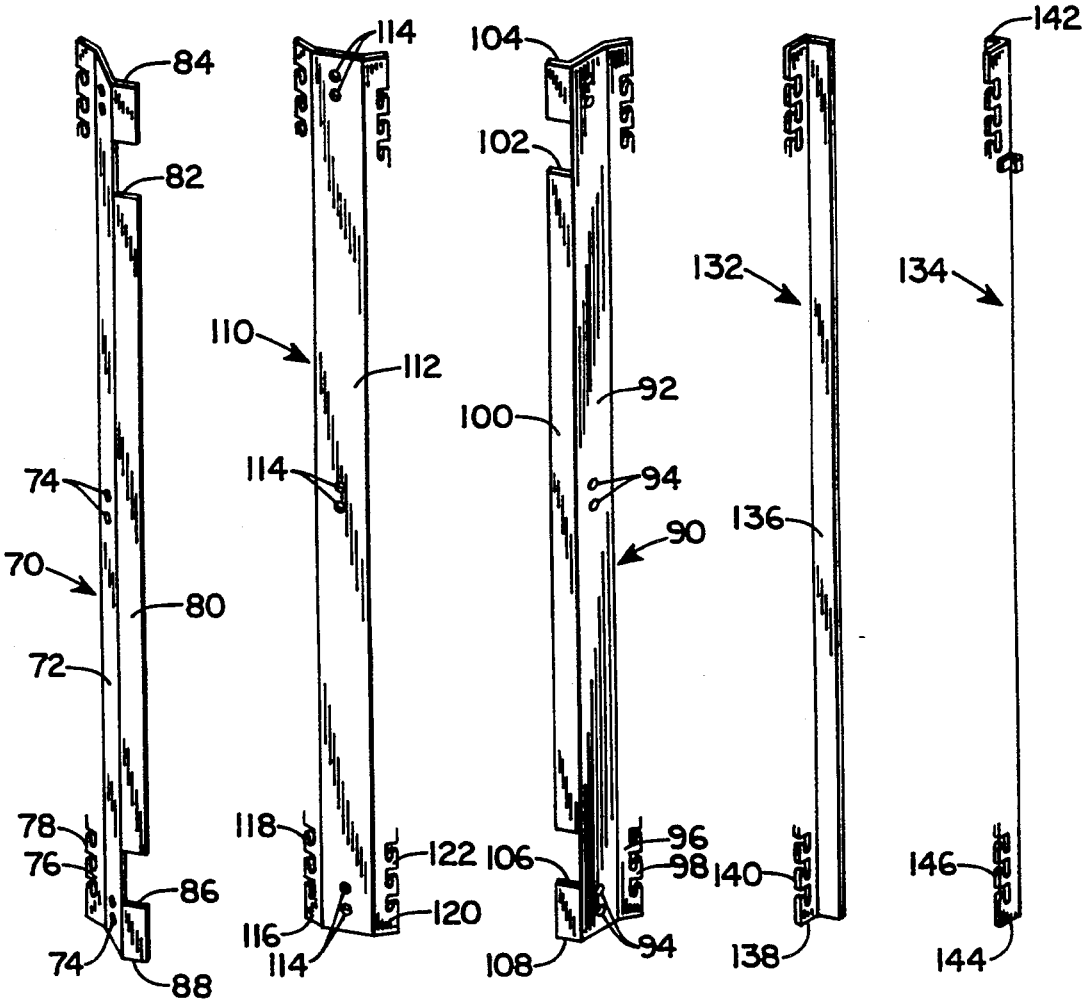
FIG. 3 illustrates the various assembly bars, and the side bars for the door.
Figure 9:
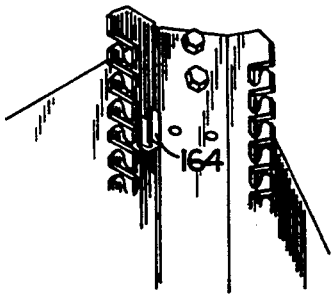
FIG. 9 illustrates the location of the clip which cooperates with the door catch.
Figure 10:
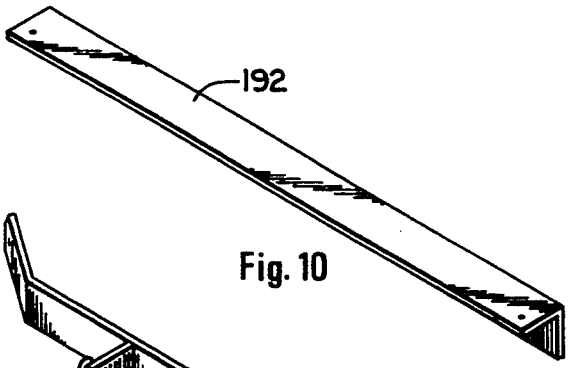
FIG. 10 illustrates a bar used to suport a grille shelf.
Figure 11:
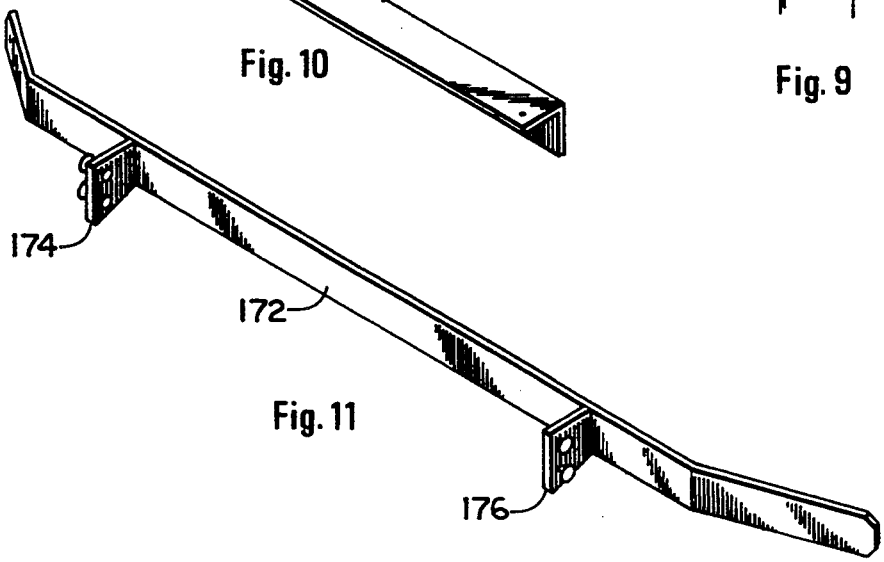
FIG. 11 illustrates a rack suitable for attachment of rods and retaining clips for the rods.
Figure 12:
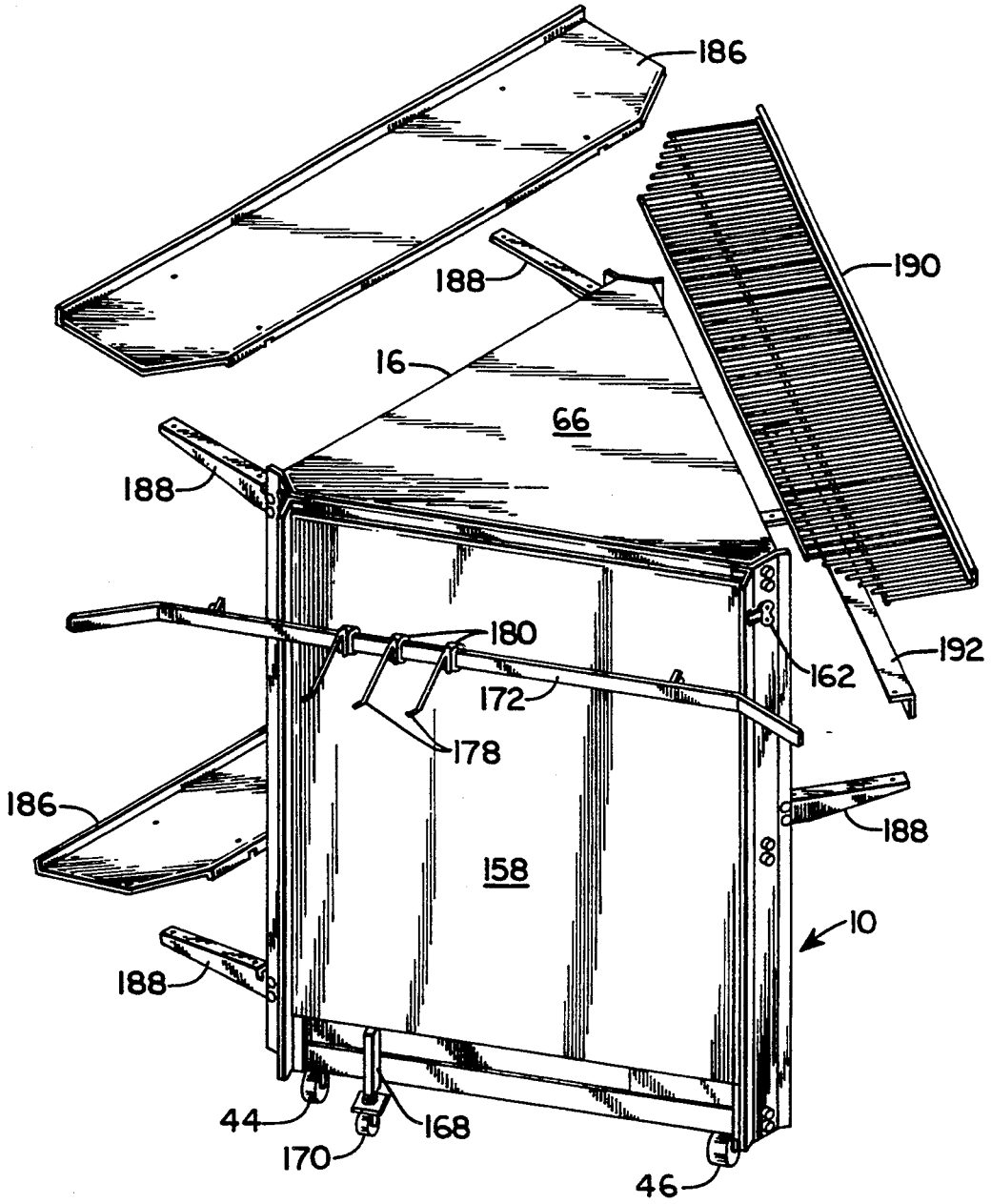
FIG. 12 illustrates the assembled stand with brackets and rack in place.

Each truncation piece is provided with two holes for assembly bolts, as illustrated in FIG. 9. Each hole is fitted with a tapped cylinder welded to the inside surface to accommodate the assembly bolts. The location of the holes is best shown in FIG. 2 and 3.

Bar 70 is formed in the shape of an open S. In bar 70 the central element 72 is flat and straight and is provided with three pairs of assembly holes 74. The angle between bracket element 76 and central element 72 is 150 degrees. Bracket element 76 is fitted with L-shaped projections 78 for the purpose of supporting shelf brackets. Element 80 of bar 70 forms an angle of 120 degrees with respect to central element 72. Element 80 has a rectangular cutout 82 near the top 84 of element 80, and a rectangular cutout 86 near the bottom 88 of element 80.

Bar 90 is a mirror image of bar 70. In bar 90 the central element 92 is flat and straight and is provided with three pairs of assembly holes 94. The angle between bracket element 96 96 and central element 92 is 150 degrees . Bracket element 96 is fitted with L-shaped projections 98 for the purpose of supporting shelf brackets. Element 100 of bar 90 forms an angle of 120 degrees with respect to central element 92. Element 100 has a rectangular cutout 102 near the top 104 of element 100, and a rectangular cutout 106 near the bottom 108 of element 100.

Bar 110 has a straight flat central element 112 which has three pairs of assembly bolt holes 114. Bracket element 116, having L-shaped projections 118, extends from one edge of central element 112, and bracket element 120, having L-shaped projections 122 extends from the other edge of central element 112. In each case, the included angle between the bracket element and the central element is 150 degrees.

Figure 4:
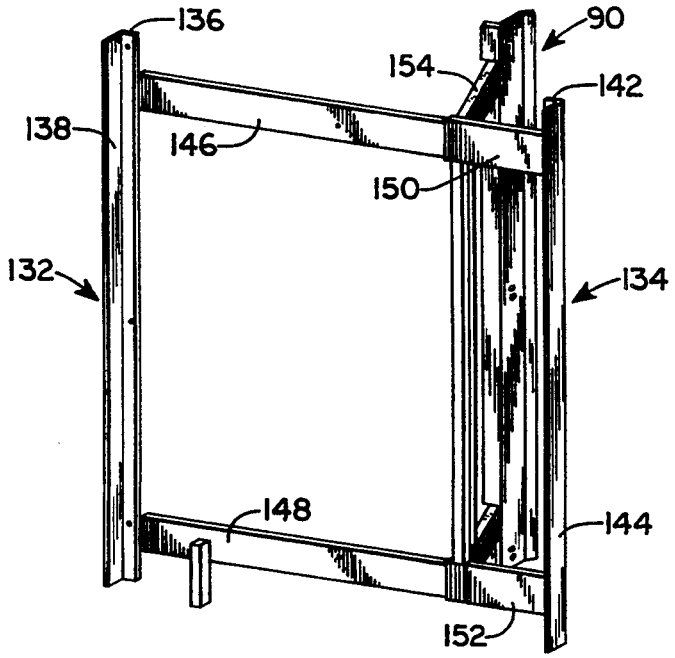
FIG. 4 illustrates the door without the closure panel.
Figure 5:
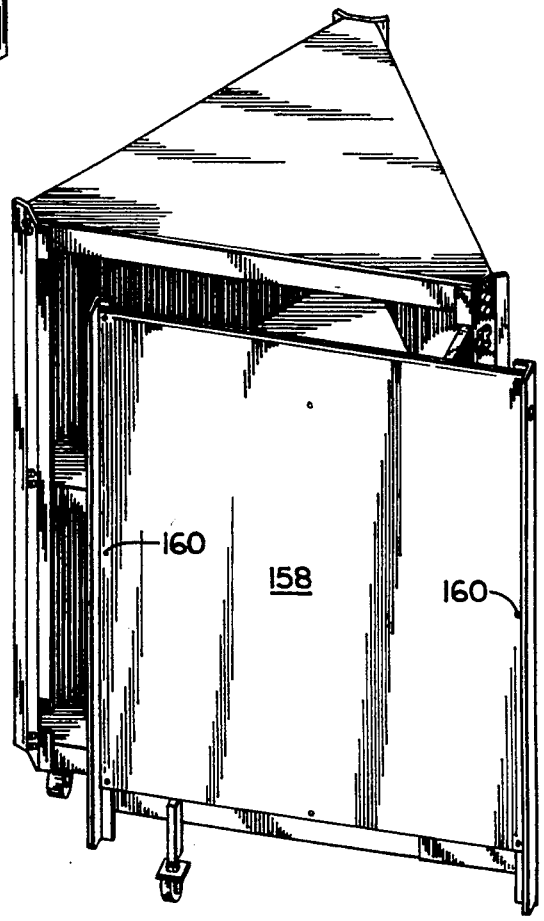
FIG. 5 illustrates the door as attached to the stand in the open position.
Figure 6:
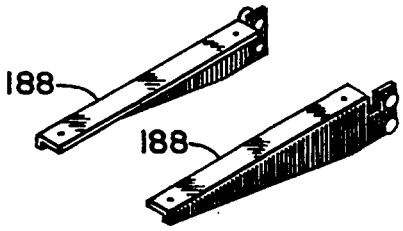
FIG. 6 illustrates brackets suitable for supporting horizontal shelves.
Figure 7:
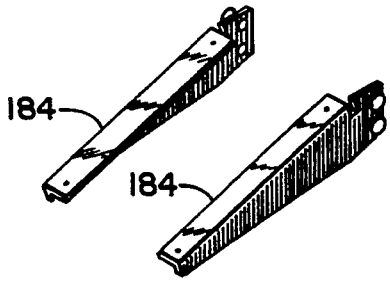
FIG. 7 illustrates brackets suitable for supporting tilted shelves.
Figure 8:
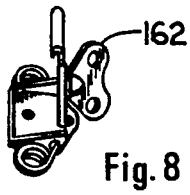
FIG. 8 illustrates the door catch.

Basic assembly of the triangle unit is illustrated in FIGS. 2, 4 and 5. Bar 80 is bolted to the truncation pieces between sides 20 and 22 of base triangle 12, to the truncation pieces between sides 48 and 52 of center triangle 14 and to the truncation pieces between sides 60 and 64 of top triangle 16. Bracket element 76 of bar 70 extends perpendicularly with respect to sides 22, 52 and 64.

Bar 90 is similarly bolted to truncation pieces 28, 56 and 68, with bracket element 96 of bar 90 projecting perpendicularly with respect to sides 18, 50 and 62.

Bar 110 is bolted to the truncation pieces between sides 18 and 22 of base triangle 12, between sides 50 and 52 of center triangle 14, and between sides 62 and 64 of top triangle 16.

Side panel 24 is permanently attached to sides 22, 52 and 64 by means of self-tapping screws inserted through holes 126 into pilot holes (not shown) in the respective sides. Side panel of 28 is permanently attached to sides 18, 50 and 62 by means self-tapping screws inserted through holes 126 into pilot holes (not shown) in the respective sides.

It can be seen that the interior of the triangle stand provides a considerable amount of storage volume. The storage area is accessed through a door 130 which encloses the third side of triangle stand 10. Bars 132 and 134 form the upright portions of door 130. Bar 132 straight flat portion 136 from which perpendicularly projects bracket portion 138 having L-shaped projections 140. Bar 134 is a mirror image of bar 136 and has straight flat portion 142 from which perpendicularly projects bracket portion 144 having L-shaped projections 146. Element 136 of bar 132 is welded to horizontal open-sided rectangular tubes 146 and 148. Element 142 of bar 134 is welded to rectangular tubes 150 and 152. Tube 146 is inserted into tube 150 and is welded to tube 150. Tube 148 is inserted into tube 152 and is welded to tube 152. Tubes 146, 148, 150 and 152 are actually C-shaped in cross-section, the open portion not being visible in FIGS. 4 and 5. Rectangular tube 154 is hinged to tube 150 at its first end, and is hinged to bar 90 at its second end. Rectangular tube 156 is hinged to tube 152 at its first end, and is hinged to bar 90 at its second end. Panel 158 is attached to bars 132 and 134 by means of self-tapping screws inserted through holes 160 in panel 158 which engage pilot holes (not shown) in bars 132 and 134. A catch 162 is attached to bar 90 near the top of element 92. Catch 162 releasably engages clip 164 which is attached to element 144 of bar 134 on door 130. The left side of door 130 (as illustrated in FIG. 5) is secured by means of a tab 166 which extends angularly from bar 146, and which engages element 72 of bar 70. A tube 168 extends downward from tube 148. Caster wheel 170 is inserted into tube 168.

Door 130 is opened by releasing catch 162 and pulling bar 134 away from triangle stand 10. The right end of door 130 swings open and tab 166 is released, allowing the door 130 to open freely, giving access to the storage space inside triangle stand 10.

Stand 10 can accommodate at least four different kinds of display fixtures. Rack 172 has brackets 174 and 176 which cooperate with the bracket projections 140 and 146 on bars 132 and 134 respectively. Rods 178, suitable for display of bagged or blister-packaged products, project from clips 180 which simply snap onto rack 172. One or more such racks may be used, as illustrated in FIG. 1.

Tilted shelves 182 are supported by brackets 184 to which shelves 182 are attached. Brackets 184 are designed to cooperate with any of the bracket projections.

Horizontal shelves 186 are supported by brackets 188 to which shelves 186 are attached. Brackets 188 are designed to cooperate with any of the bracket projections.

Grille shelf 190 is supported by bar 192 which is attached to and supported at the outer ends of a pair of brackets 188, and grille shelf 190 is supported at its inner side by brackets 188 as well.

In FIGS. 1, 2, 4, 5 and 12 it will be noted that the bracket support projections are not shown. This is because the projections are so small that the edges having projections would appear simply as broad black lines with no real definition.

This specification describes, and the figures illustrate, a triangle shaped merchandise display and storage stand which can utilize several different types of shelves and display rods, and which can be moved easily to different locations within the store.

While this invention is susceptible of embodiment in different forms, the drawings and the specification illustrate the preferred embodiment of the invention, with the understanding that the present disclosure is to be considered an exemplification of the principles of the invention, and the disclosure is not intended to limit the invention to the particular embodiment described.

We claim:

1. A triangular merchandise display and storage stand comprising:

a planar bottom triangular piece, a planar center triangular piece a planar top triangular piece, the triangular pieces being vertically spaced apart with their triangular planar surfaces horizontal, each of said triangular pieces being of the same dimensions, and each of said triangular pieces being truncated at each apex such that the periphery of each triangular piece consists of three long sides interconnected by three short sides;

a narrow side element extending downwardly from each of the six sides each triangular piece, with each of the side elements of each triangular piece being joined to another of said side elements such that a continuous downwardly-extending element is formed completely around the periphery of each triangular piece;

the portion of the downwardly-extending element which extends down from each short side of each triangular piece being bolted to a vertical bar, such that each vertical bar interconnects one of short sides of each triangular piece;

a planar first panel extending from the top triangular piece to the bottom triangular piece, said first panel being secured to that portion of the downwardly-extending element which extends down from a first of said long sides of each triangular piece, and having a width substantially equal to the length of said long sides;

a planar second panel extending from the top triangular piece to the bottom triangular piece, said second panel being secured to that portion of the downwardly extending element which extends down from a second of said long sides of each triangular piece, and having a width substantially equal to the length of said long sides;

a door hinged to the top triangular piece and to the bottom triangular piece, and fully extending across the third of said long sides of each triangular piece when the door is closed; and the bottom triangular piece having wheels fitted to an underside thereof near each short side thereof.

2. The stand of claim 1 wherein each vertical bar has two parallel vertical sides, each of said vertical sides being provided projections extending horizontally, said projections being adapted to support shelf brackets.

3. The stand of claim 1 wherein the wheel near the short side joining said first and second long sides is a caster wheel, and the other two wheels are fixed wheels.

4. The stand of claim 1 and further including means to support horizontal display shelves, tilted display shelves and grille display shelves as well as rods for display of bagged and blister-packed items.

* * * * *